United States Patent [19]

Whalen

[11] Patent Number: 4,600,254

[45] Date of Patent: Jul. 15, 1986

[54] SLIDING DOOR HAVING PINION AND IDLER WHEEL

[75] Inventor: Robert T. Whalen, Toronto, Canada

[73] Assignee: Steelcase Canada Ltd., Markham, Canada

[21] Appl. No.: 514,989

[22] Filed: Jul. 18, 1983

[51] Int. Cl.[4] ..... E05D 15/58

[52] U.S. Cl. ..... 312/323; 49/258; 312/110; 312/138 R

[58] Field of Search ..... 312/109, 110, 138 R, 312/139, 322, 323, 331, 328, 350; 248/286, 429, 430; 108/143; 49/254, 258; 384/266; 403/375, 360

[56] References Cited

U.S. PATENT DOCUMENTS

| | | | |
|---|---|---|---|
| 644,434 | 2/1900 | Macey | 312/110 |
| 683,126 | 9/1901 | Linquist | 384/266 |
| 726,411 | 4/1903 | De Knight | 312/110 |
| 726,957 | 5/1903 | Macey | 312/109 |
| 810,233 | 1/1906 | Tobey | 312/109 |
| 902,995 | 11/1908 | Oles | 312/109 |
| 2,215,424 | 9/1940 | Klein | 403/360 X |
| 3,013,853 | 12/1961 | Toms | 312/323 |
| 3,429,199 | 2/1969 | Kenyon | 403/375 X |
| 3,655,226 | 4/1972 | Cowan | 403/375 X |
| 3,748,005 | 7/1973 | Chovanec et al. | 312/109 |
| 3,794,401 | 2/1974 | Dean et al. | 312/323 |
| 4,265,502 | 5/1981 | Bloodee et al. | 312/109 |
| 4,375,907 | 3/1983 | Vander Kooi et al. | 312/109 |

FOREIGN PATENT DOCUMENTS

| | | | |
|---|---|---|---|
| 521125 | 1/1956 | Canada | 384/266 |
| 534177 | 9/1931 | Fed. Rep. of Germany | 49/258 |
| 2418193 | 10/1975 | Fed. Rep. of Germany | 312/138 R |
| 305727 | 2/1933 | Italy | 312/323 |
| 522723 | 6/1940 | United Kingdom | 312/110 |

*Primary Examiner*—William E. Lyddane
*Assistant Examiner*—Thomas A. Rendos
*Attorney, Agent, or Firm*—Rogers, Bereskin & Parr

[57] ABSTRACT

A horizontal sliding door for a housing such as a cabinet. An axle rotatably mounted at the rear of the door projects into two identical tracks one at each side of the housing. Each track has a lower toothed rack and an upper stop surface facing the rack. A pinion slideably and non-rotatably mounted on each end of the axle engages the rack and is held there by an idler wheel slideably and rotatably mounted beside each pinion. A spacer sleeve near one end of the axle is removable, allowing one pinion and idler wheel to be slid inwardly, allowing removal of the door by passing that one end of the axle through a slot in one end of the track.

15 Claims, 6 Drawing Figures

SLIDING DOOR HAVING PINION AND IDLER WHEEL

This invention relates to a sliding door for a housing such as a cabinet.

Cabinets, particularly filing cabinets, are often provided with sliding doors which when opened lie horizontally beneath the upper surface of the cabinet or shelf thereof and which can be slid forwardly and pivoted downwardly to close the cabinet or a shelf thereof. (Such doors are commonly known in the trade as flipper doors.) The mechanisms for such sliding doors are generally expensive and complex. In addition the doors tend to occupy substantial space when they are open, and they also frequently tend to bind during attempts to close them. Because of the difficulty of using such doors, they are often left permanently open, defeating their purpose and resulting in waste of their extra cost.

Accordingly it is an object of the present invention to provide an improved door structure for a housing such as a cabinet, in which a relatively simple mechanism permits the door to be slid smoothly back and forth and closed without binding. In its broadest aspect the invention provides, in a housing, a door structure comprising:

(a) a door, (b) a pair of elongated tracks one on each side of said door and each mounted on said housing, (c) each track having a toothed elongated first surface and a flat longitudinal second surface spaced from and extending parallel to and facing said first surface, (d) an axle rotatably mounted on said door and having a pair of ends one projecting into each track, (e) a pinion non-rotatably mounted on each end of said axle, (f) an idler wheel rotatably mounted on each end of said axle adjacent said pinion, (g) the spacing between said first and second surfaces and the diameters of said pinions and idler wheels being such that each pinion engages said teeth in its associated first surface and is clear of its associated second surface and each idler wheel contacts its associated second surface and is clear of its associated first surface, so that as said door is moved back and forth in said housing, said pinion wheels rotate together in engagement with said teeth to keep said door aligned in said cabinet and said idler wheels rotate in a direction opposite to that of said pinions and maintain said pinions in engagement with said teeth.

Further objects and advantages of the invention will appear from the following description, taken together with the accompanying drawings in which.

Figure 1:
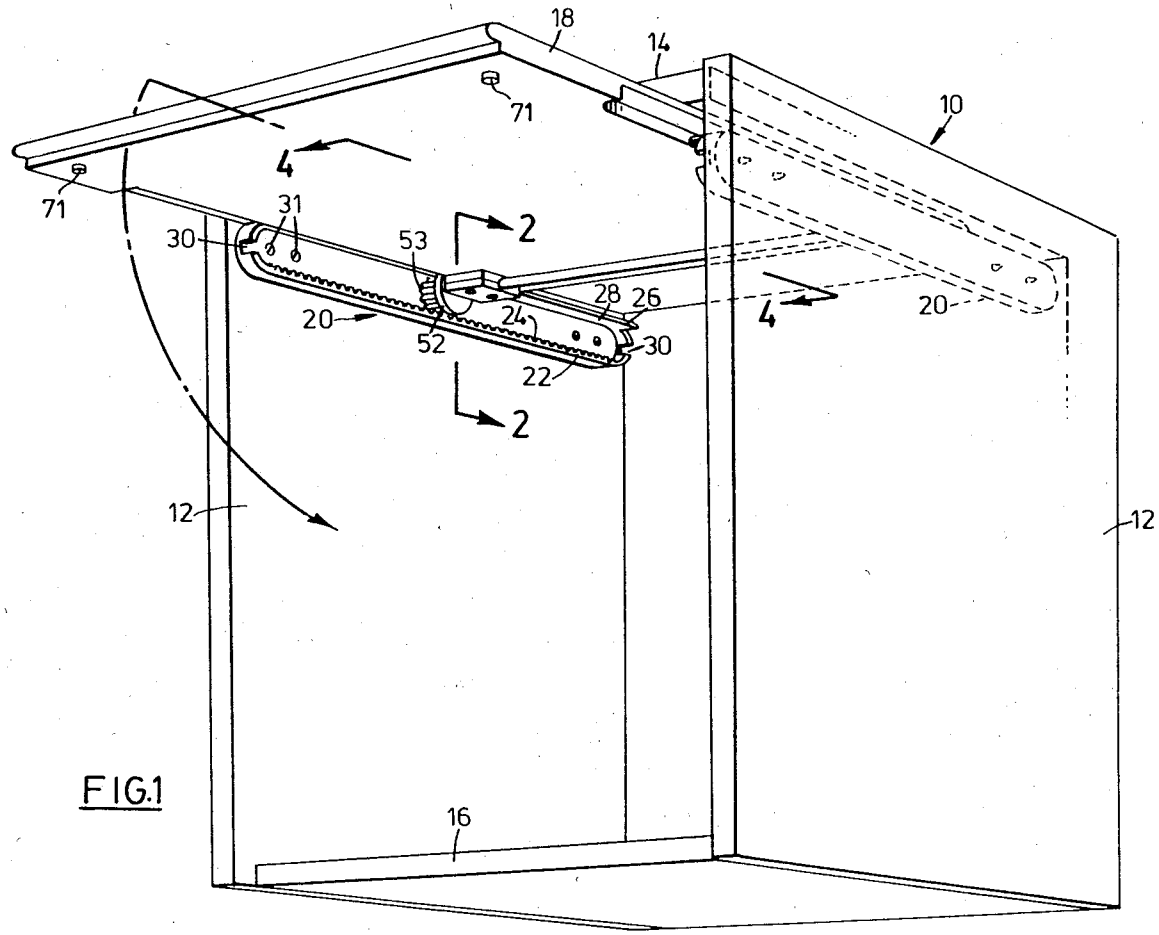
FIG. 1 is a perspective view of a cabinet showing a door according to the invention in its horizontal position but slid part way toward a position in which the door can be closed.

Reference is first made to FIG. 1, which shows an exemplary cabinet 10 having a pair of opposed sides 12, a top 14 and a bottom 16. A door 18 is provided to close the cabinet. The door 18 is mounted on a pair of opposed elongated tracks 20, one mounted on each side of the cabinet 10. The tracks 20 are identical and therefore only one will be described.

Figure 2:
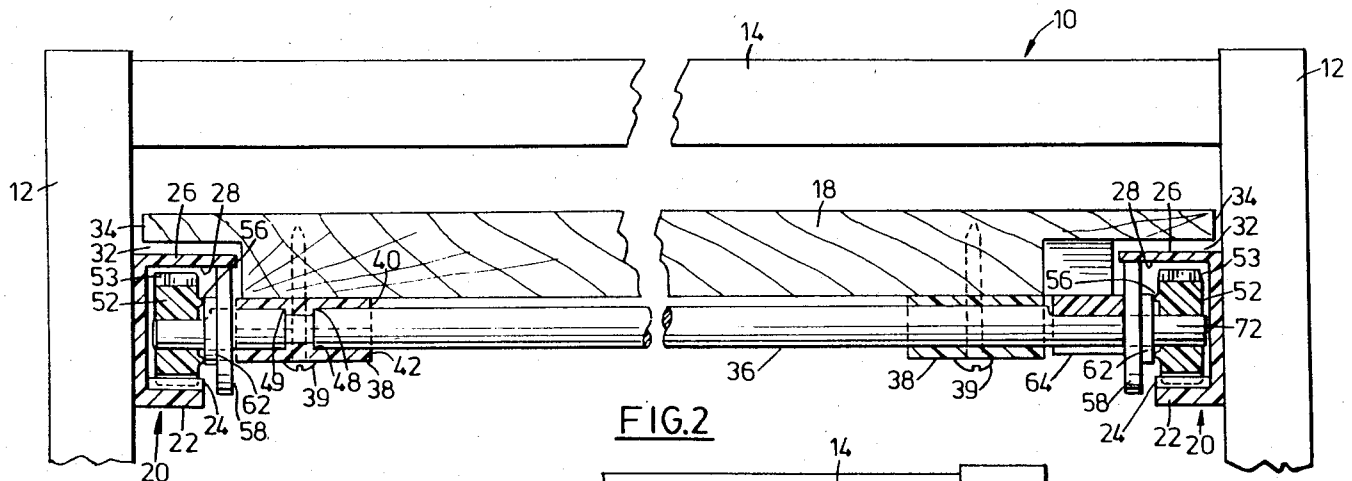
FIG. 2 is a view, partly in section, along lines 2—2 of FIG. 1.
Figure 4:
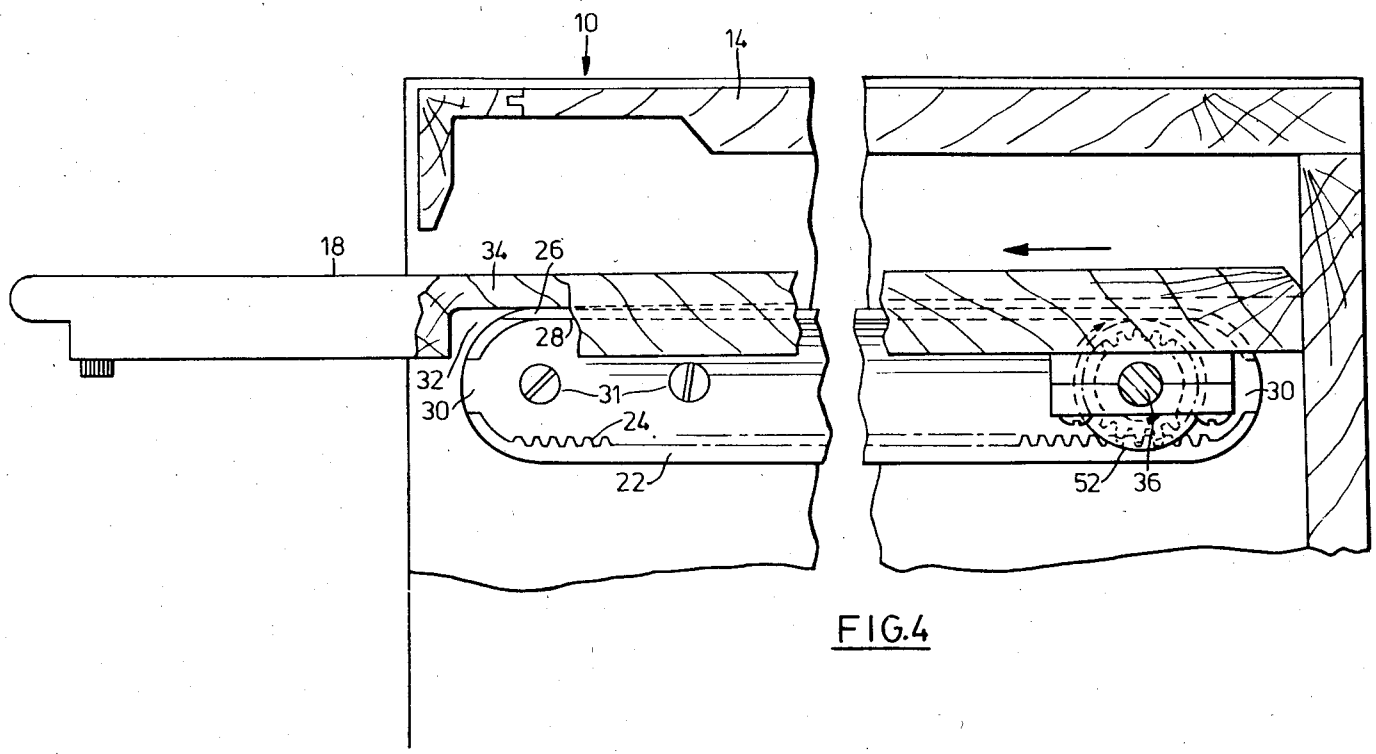
FIG. 4 is a section taken along lines 4—4 of FIG. 1.

As shown in FIG. 1 and also in the remaining drawings, particularly FIGS. 2 and 4, each track 20 extends horizontally from a position adjacent the rear of the cabinet to a position adjacent the front of the cabinet. The track 20 includes an elongated lower portion or rack 22 formed with upwardly facing teeth 24. The rack 22 extends horizontally substantially the entire length of the track. The track 20 also includes an upper portion 26 having a downwardly facing flat surface 28. The surface 28 extends parallel to and spaced above the rack 22, over substantially the entire length of the track. As best shown in FIG. 2, the upper portion 26 projects laterally inwardly to a greater extent than does the rack 22.

The front and back of the track 20 are each curved in the form of a semicircle and each has a laterally extending slot 30 at its center, for a purpose to be described.

The tracks 20 are secured to the sides 12 of the cabinet by positioning screws 31. Normally the holes (not shown) in the tracks 20 through which the screws 31 protrude will be enlarged to allow fine adjustment of the position of the tracks 20.

Figure 6:
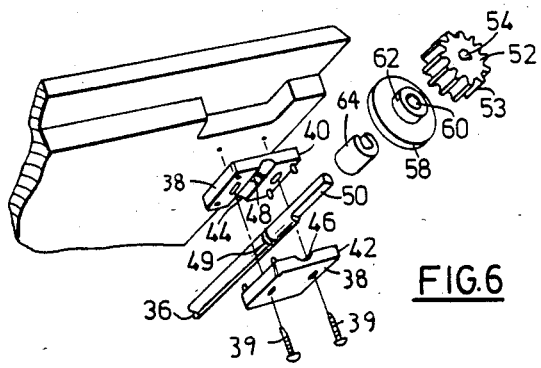
FIG. 6 is an exploded view showing a portion of the mechanism for mounting the axle on the door.

The lower surfaces of the side edges of the door 18 are recessed as indicated at 32 so that a portion 34 of each side edge of the door extends over the upper portions 26 of the tracks and extends nearly to its associated side 12 of the cabinet. An axle 36 extends across the door near its rear and is mounted for rotation on the door by a pair of bearing blocks 38. The bearing blocks 38 as best shown in FIGS. 2 and 6, are secured to the door by screws 39. Each bearing block 38 comprises upper and lower plates 40, 42 each having a semicircular groove 44, 46 therein to accommodate the axle 36. Each groove 44, 46 has a small ridge or key 48 (FIG. 2) therein which fits within a circular recess 49 in each side of the axle 36. This prevents the axle 36 from moving sideways while permitting it to rotate. The axle 36 also has a flat 50 on each end thereof, for a purpose now to be described.

A pinion 52 having teeth 53 is slideably mounted on each end of the axle 36. Each pinion 52 has therein a flattened hole 54 which matches the flat 50 at the end of the axle 36 so that the pinions 52 cannot rotate on the axle. Each pinion 52 has a small laterally inwardly extending hub 56.

Figure 3:
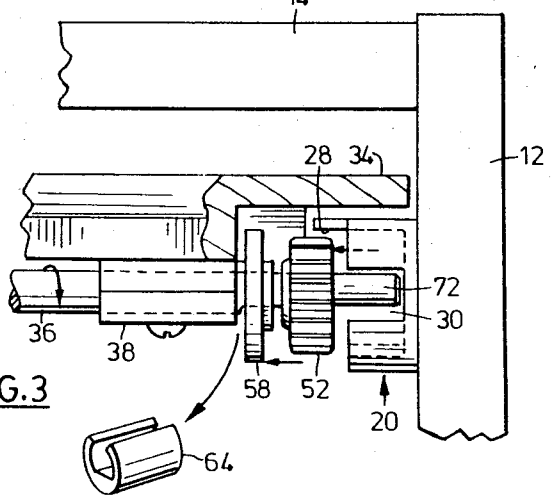
FIG. 3 is a view of a portion of the FIG. 2 mechanism showing how the door may be removed from the cabinet.

Also slideably mounted on each end of the axle 36, inwardly of each pinion 52, is an idler wheel 58. Each idler wheel 58 has a fully circular interior hole 60 so that it is free to rotate on the axle 36. The idler wheel 58 is of diameter slightly greater than that of the pinion 52, as best shown in FIGS. 2 and 3, and has a small laterally outwardly extending hub 62. The hubs 56, 62 space the main body of the idler wheel 58 laterally inwardly of the pinion 52.

In addition a spacer sleeve 64 (FIGS. 2, 3 and 6) is mounted on the right hand side of the axle 36 as shown in the drawings. The spacer sleeve 64 is in the form of an annular piece of resilient plastic extending around approximately three quarters of an arc (270°) so that it can be clipped onto or off the axle as desired. (The extent of the arc can be reduced so long as it is sufficiently more than 180° that the sleeve will remain on the axle.)

The operation of the mechanism described is as follows. When the door is in the position shown in FIG. 1 and is to be moved backwards or forwards, the pinions 52 engage the teeth 24 of the tracks 20 and maintain the sides of the door 18 in alignment with the sides of the cabinet 10, so that the door will not bind during its movement. The pinions 52 are trapped against the teeth 24 by the idler wheels 58, which as best shown in FIG. 2 engage against the flat surfaces 28 of the tracks 20. As shown in FIG. 2, the lower portions of the idler wheels 58 ride beside but are spaced laterally inwardly of the racks 22. Since the pinions 52 are of smaller diameter than the idler wheels 58, the tops of the pinions 52 are clear of the upper sufaces 28 of the tracks 20. Thus as the door 18 is moved, the pinions 52 will rotate in one direction and the idler wheels 58 will rotate in the opposite direction to allow smooth movement of the door.

When the door is in the position shown in FIG. 1, it is held from falling by engagement of its overlapping edge portions 34 on the upper portions 26 of the tracks and by the pinions 52 which rest on the teeth 24. However when the door 18 is moved sufficiently forwardly that it tends to overbalance, it is then supported both by the contact of its overlapping side portions 34 on the upper portions 26 of the tracks 20, and also by the idler wheels 58 which engage on the upper surfaces of the tracks 20.

Figure 5:
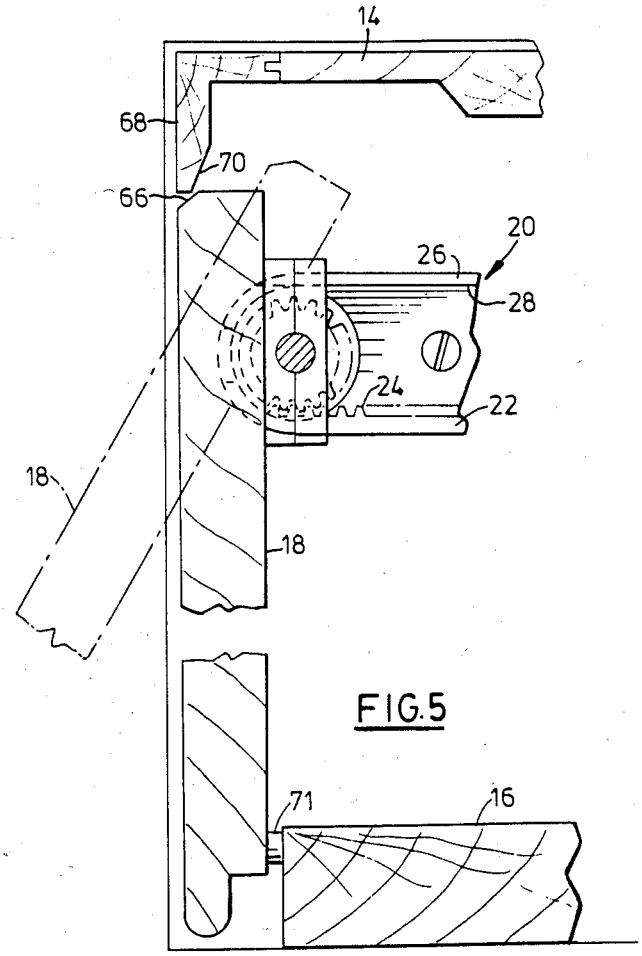
FIG. 5 is a side sectional view showing the door in solid lines closed and in chain dotted lines partly closed.

When the door is moved sufficiently far forwardly so that its axle 36 reaches the front of the tracks 20, the tops of the tracks 20 cease to support the door 18, and the door may then be rotated about the axle 36 to its closed position as shown in FIG. 5. During such rotation the axle 36 remains stationary and does not rotate, since it is held by the pinions 52 which engage with the teeth 24.

As shown in FIG. 5, the rear front edge of the door 18 is bevelled, as indicated at 66. In addition, the cabinet includes an upper skirt 68 which has a bevelled lower inner edge 70. When the door 18 is closed, as shown in the solid line position in FIG. 5, the two bevelled edges lie against each other (with a slight clearance) and eliminate any visible gap at the top of the door. The bottom edge of the door 18 overlaps the bottom 16 of the cabinet and is fitted with rubber stops 71.

If it is desired to remove the door from the cabinet, the spacer sleeve 64 is removed from the axle. This can normally be done simply by hand. The right hand idler wheel 58 and pinion 52 are then slid inwardly to the position shown in FIG. 3. The door 18 may then be moved forwardly until the axle 36 reaches the front of the tracks 20, at which time the right hand end 72 of the axle 36 may be moved forwardly through the front slot 30 in the right hand track 20. After this has been done the door may be moved sideways to remove the other pinion 52 and idler wheel 58 from the left hand track 20.

To assemble the door to the cabinet the procedure just described is reversed. With the right hand idler wheel 58 in the positions shown in FIG. 3, the left hand pinion 52 and idler wheel 58 are inserted into the left hand track 20. The right hand end 72 of the axle 36 is then moved through the front slot 30 in the right hand track 20. The right hand pinion 52 and idler wheel 58 are then slid to the right from the FIG. 3 position to the FIG. 2 position. Care must be taken to insert the teeth 53 of the pinion 52 into the proper teeth 24 of the right hand rack 22 so that the door is aligned at right angles to the direction of movement of the door. Next the door 18 is slid rearwardly slightly, and the spacer sleeve 64 is snapped back into position.

The system described is inexpensive to manufacture, since both tracks 20 are identical and are symmetrical, so that either end of each track can face forwardly. The pinions and idler wheels 52, 58 are also identical. The only non-symmetrical features are the spacer sleeve 64, which requires an extra width recess at one side of the door 18 and the axle 36 which has extra length at its right hand side to accommodate the spacer sleeve 64. The tracks, pinions, idler wheels and bearing blocks are preferably all molded of a suitable plastic material.

Although the invention is intended for use primarily with horizontal sliding doors, it can also be used for doors which have other orientations, e.g. doors which are vertically oriented and slide beside the side of a cabinet or divider.

I claim:

1. A housing having a door structure comprising:

(a) a door, (b) a pair of elongated tracks one on each side of said door and each mounted on said housing, (c) each track having a toothed elongated first surface and a flat longitudinal second surface spaced from and extending parallel to and facing said first surface, (d) an axle rotatably mounted on said door and having a pair of ends one projecting into each track, (e) a pinion non-rotatably mounted on each end of said axle, (f) an idler wheel rotatably mounted on each end of said axle adjacent said pinion, (g) the spacing between said first and second surfaces and the diameters of said pinions and idler wheels being such that each pinion engages said teeth in its associated first surface and is clear of its associated second surface and each idler wheel contacts its associated second surface and is clear of its associated first surface, so that as said door is moved back and forth in said housing, said pinion wheels rotate together in engagement with said teeth to keep said door aligned in said cabinet and said idler wheels rotate in a direction opposite to that of said pinions and maintain said pinions in engagement with said teeth, (h) at least one pinion and its associated idler wheel being slideable laterally along said axle, and (i) a spacer member removably mounted on said axle for holding such slidable pinion and idler wheel in their associated track, so that said spacer member can be removed and said pinion and idler wheel slid along said axle out of said track to facilitate removal of said door from said housing.

2. A housing according to claim 1 wherein said spacer member is a resilient annular member extending around a portion of an arc.

3. A housing according to claim 1 wherein each track has a slot at its front between said first and second surfaces, said slot being dimensioned to permit said axle to pass therethrough, so that after said slidable pinion and idler wheel have been slid inwardly along said axle, said axle can be passed through said space to facilitate removal of said door from said housing.

4. A housing according to claim 1 wherein each idler wheel is mounted inwardly of its associated pinion and is of diameter greater than its associated pinion, and wherein said second surface of each track projects laterally inwardly to an extent greater than said first surface, each idler wheel extending vertically beside said first surface.

5. A housing according to claim 4 and having a pair of opposed sides, one said track being mounted on each side, each track having a front end, said front ends of said tracks being curved to permit pivoting of said door smoothly about said axle when said door is moved forwardly to the front of said housing.

6. A housing according to claim 5 wherein the side edges of said door have recessed surfaces forming laterally outwardly projecting edges of said door, said projecting edges projecting over said second surfaces of said tracks and resting thereon during at least a portion of the movement of said door.

7. A housing according to claim 6 wherein said door when closed has a top and further has a bottom rear edge, said rear edge of said door being bevelled and wherein said housing has an upper skirt extending between said sides and having a lower edge, the inner surface of said lower edge being bevelled so that the bevel on said rear edge of said door contacts the bevel on said inner surface of said lower edge of said skirt when said door is closed, whereby substantially to eliminate any gap between the top of said door and said skirt when said door is closed.

8. A housing according to claim 4 and including means mounted on said door for preventing side to side movement of said axle on said door.

9. A housing according to claim 1 wherein each track is constituted by a single plastic member, each track having a rounded front and a rounded rear and a slot in each of said front and rear, said slot being dimensioned to permit said axle to pass therethrough.

10. A housing according to claim 1 wherein said housing has a top and said tracks extend horizontally adjacent said top of said housing so that said door, when it is open, lies horizontally adjacent said top of said housing and lies, when it is closed, in a vertical plane.

11. A housing according to claim 1 wherein said axle is mounted on said door by a pair of blocks, each block having a cylindrical aperture extending therethrough through which said axle passes, said aperture snugly but rotatably accommodating said axle, each block comprising a pair of disengageable mating halves, each half having therein half of said cylindrical aperture, one of said pair of halves having centrally located in said aperture a circumferential ridge projecting into said aperture and said axle having a mating circumferential recess therein, said ridge being engaged in said recess to prevent lateral movement of said axle relative to said door.

12. A set of parts for mounting a door having an axle mounted thereon on a housing, said set of parts comprising:

(a) a pair of elongated tracks adapted to be mounted one at each side of said door on said housing, (b) each track having a toothed elongated first surface and a flat longitudinal second surface spaced from and extending parallel to and facing said first surface, (c) a pair of pinions one adapted to be mounted on each end of said axle and each pinion having an interior opening having means therein to engage said end of said axle so that said pinion cannot rotate on said end of said axle, (d) a pair of idler wheels each adapted to be rotatably mounted on an end of said axle adjacent a said pinion, (e) the spacing between said first and second surfaces and the diameters of said pinions and idler wheels being such that when said set is assembled, each pinion will engage said teeth in its associated first surface and be clear of its associated second surface and each idler wheel will contact its associated second surface and be clear of its associated first surface, so that as said door is moved back and forth in said housing, said pinion wheels rotate together in engagement with said teeth to keep said door aligned in said cabinet and said idler wheels rotate in a direction opposite to that of said pinions and maintain said pinions in engagement with said teeth, (f) at least one pinion and its associated idler wheel being slidable laterally along said axle when such pinion and associated idler wheel are mounted on said axle, (g) a spacer member adapted to be removably mounted on said axle for holding such slidable pinion and idler wheel in their associated track when said set is assembled, so that when said set is assembled, said spacer member can be removed and said pinion and idler slid along said axle out of said track to facilitate removal of said door from said housing.

13. A set of parts according to claim 12 wherein each track has a slot at its front between said first and second surfaces, said slot being dimensioned to permit said axle to pass therethrough.

14. A set of parts according to claim 12 wherein each idler wheel is of diameter greater than its associated pinion and wherein said track has an elongated side surface joining said first and second surfaces, said second surface of each track projecting laterally from said side surface to an extent greater than said first surface.

15. A set of parts according to claim 14 wherein each track has a pair of ends, said ends of said tracks being smoothly curved in a semi-circular configuration.

* * * * *